US006694895B2

(12) United States Patent
Gillis

(10) Patent No.: US 6,694,895 B2
(45) Date of Patent: Feb. 24, 2004

(54) TRAY FOR SUPPORTING A COMPUTER KEYBOARD AND MOUSE ON SUBSTANTIALLY A COMMON HORIZONTAL PLANE

(76) Inventor: Charles A. Gillis, 5501 Harvest Scene Ct., Columbia, MD (US) 20144

( * ) Notice: Subject to any disclaimer, the term of this patent is extended or adjusted under 35 U.S.C. 154(b) by 0 days.

(21) Appl. No.: 09/986,255

(22) Filed: Nov. 8, 2001

(65) Prior Publication Data

US 2003/0084828 A1 May 8, 2003

(51) Int. Cl.[7] ..... A47B 9/00
(52) U.S. Cl. ..... 108/102; 108/65
(58) Field of Search ..... 108/102, 104, 108/143, 131, 65, 92; 248/118, 118.1, 345.01

(56) References Cited

U.S. PATENT DOCUMENTS

| | | | | | |
|---|---|---|---|---|---|
| 83,460 | A | * | 10/1868 | Carroll | 108/65 |
| 2,182,703 | A | * | 12/1939 | Rainwater | 108/92 |
| 4,862,165 | A | | 8/1989 | Gart | |
| 5,165,630 | A | | 11/1992 | Connor | |
| 5,265,835 | A | | 11/1993 | Nash | |
| D347,422 | S | | 5/1994 | Taslitz | |
| 5,335,888 | A | | 8/1994 | Thomsen | |
| 5,340,067 | A | | 8/1994 | Martin et al. | |
| D352,933 | S | | 11/1994 | Vaule | |
| D352,934 | S | | 11/1994 | Juster | |
| D356,785 | S | | 3/1995 | Dickerson et al. | |
| 5,414,445 | A | | 5/1995 | Kaneko et al. | |
| 5,433,407 | A | | 7/1995 | Rice | |
| 5,583,496 | A | * | 12/1996 | Sharpe et al. | 341/22 |
| 5,655,743 | A | | 8/1997 | Gillis | |
| 5,732,910 | A | * | 3/1998 | Martin | 248/118 |
| 6,045,098 | A | * | 4/2000 | Timm | 248/118 |
| 6,353,530 | B1 | * | 3/2002 | Zarek et al. | 108/131 |

FOREIGN PATENT DOCUMENTS

| | | | | |
|---|---|---|---|---|
| DE | 3429188 | * | 2/1986 | A47B/21/02 |
| EP | 0181843 | * | 5/1986 | A47B/11/00 |

* cited by examiner

*Primary Examiner*—Lanna Mai
*Assistant Examiner*—Jerry A Anderson
(74) *Attorney, Agent, or Firm*—Diller, Ramik & Wight

(57) ABSTRACT

The invention is directed to a tray which includes a base having an upwardly opening open-ended groove and a member slidable in the groove for limited right-to-left and left-to-right movements in a horizontal plane. Upper surfaces of the base and the slidable member lie substantially in a common plane such that at least two input devices, such as a keyboard and a mouse, can be supported thereon on substantially the same horizontal plane.

34 Claims, 2 Drawing Sheets

TRAY FOR SUPPORTING A COMPUTER KEYBOARD AND MOUSE ON SUBSTANTIALLY A COMMON HORIZONTAL PLANE

THE TECHNICAL FIELD

The present invention relates to a tray for supporting multiple input devices, such as a keyboard and a mouse, on substantially a common plane and for accommodating both left-handed and right-handed people.

BACKGROUND OF THE INVENTION

Current keyboard/mouse trays have an upper surface for supporting a keyboard and a lower surface for supporting a mouse. The mouse supporting surface generally extends out from the keyboard tray at a level beneath the keyboard upper surface. Usually, the lower surface extends out from beneath or from a chamber within the keyboard tray. For example, as is disclosed in U.S. Pat. No. 5,655,743 issued to the inventor, a keyboard tray has a relatively flat mouse tray that slides out from a chamber within the keyboard tray.

Specifically, the keyboard tray of the '743 patent is rigidly secured to a keyboard tray supporting arm which is articulately mounted relatively to a desk upon which is supported a conventional personal computer (PC). The keyboard tray provides a relatively flat mouse tray in slidable relationship thereto. The keyboard tray is constructed from two pieces of compression molded, injection molded, vacuum molded or like formed polymeric/copolymeric synthetic plastic material which when united along a periphery thereof define upper and lower walls and a peripheral wall therebetween. The peripheral wall includes spaced opposite side wall portions each of which has a slot.

The peripheral wall maintains the upper and lower walls in generally spaced relationship and defines therebetween a relatively flat chamber. It is within the flat chamber that the relatively flat mouse tray is slidably housed with each of opposite side edges thereof being disposed generally adjacent the slots of the keyboard tray when the mouse tray is substantially housed within the flat chamber.

The mouse tray can be slid either to the left or to the right, as viewed from the perspective of the user thereof, such that opposite side edge portions and the upper surface thereof can alternately project beyond the slots and movably support thereupon a mouse while the associated keyboard is supported atop the upper wall of the keyboard tray. In this fashion a user can utilize an associated keyboard during the support thereof by the keyboard tray and can also manipulate a mouse associated with the personal computer upon either the left-hand or right-hand upper surface of the mouse tray.

The mouse tray includes a projection for limiting the sliding movement thereof to the left and/or the right which assures that a limited predetermined area of the mouse tray can be slid either to the left or to the right which is sufficient to accommodate manipulation of the mouse, yet the exposure is not so large as to create an imbalance or undesired leverage should, for example, the user heavily rest his/her arm upon the exposed side edge portion of the tray which might tend to break the same or torque the keyboard tray sufficiently to break it away from the articulated mounting arm or at a minimum loosen the fastenings (generally screws) between the keyboard tray and the articulated mounting arm.

The upper surface of the mouse tray has a relatively shallow recess in which is adhesively adhered a sheet of material having an upper surface of a high coefficient of friction which reduces mouse slippage and/or inadvertent mouse movement.

Prior art related to keyboards, keyboard trays, wrist rests and the like are reflected in the following U.S. patents:

Taslitz U.S. Design Pat. No. 347,422 Issued: May 31, 1994

Vaule U.S. Design Pat. No. 352,933 Issued: Nov. 20, 1994

Juster U.S. Design Pat. No. 352,934 Issued: Nov. 29, 1994

Dickerson U.S. Design Pat. No. 356,785 Issued: Mar. 28, 1995

Gart U.S. Pat. No. 4,862,165 Issued: Aug. 29, 1989

Connor U.S. Pat. No. 5,165,630 Issued: Nov. 24, 1992

Nash U.S. Pat. No. 5,265,835 Issued: Nov. 30, 1993

Thomsen U.S. Pat. No. 5,335,888 Issued: Aug. 9, 1994

Martin U.S. Pat. No. 5,340,067 Issued: Aug. 23, 1994

Kaneko U.S. Pat. No. 5,414,445 Issued: May 9, 1995

Rice U.S. Pat. No. 5,433,407 Issued: Jul. 18, 1995

SUMMARY OF THE INVENTION

This disclosure is directed to a keyboard/mouse tray particularly adapted for supporting multiple input devices, for example, a computer keyboard and an associated mouse, on substantially the same planar surface for both left-hand and right-hand usage. The keyboard/mouse tray (hereinafter "tray") is formed as a base and slide member. Both the base and slide member can be made of compression molded, injection molded or like molded polymeric/copolymeric synthetic materials or from sheets of milled material, such as polymeric/copolymeric synthetic plastic material, wood, metal or composites thereof. The slidable member is disposed in a groove opening upwardly through a top surface and end-wise outwardly of opposite end surfaces of the base.

The slidable member preferably includes at each of opposite ends thereof a stop carried by a bottom surface of the slidable member. The stops limit outward sliding movement of the slidable member relative to the base groove.

A mounting plate is affixed to or molded as an integral bottom portion of the base and functions to provide sufficient material to achieve the efficient purchase or grip of screws which unite the tray to an end of an associated conventional articulated or fixed tray supporting arm. An opposite end of the tray supporting arm is generally attached to a desk, a table or other support structure.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
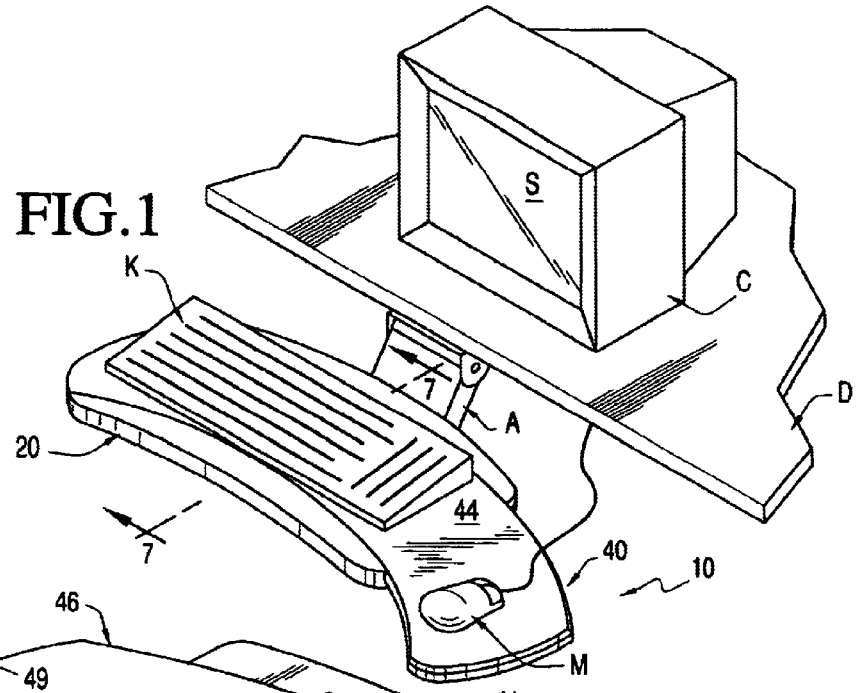
FIG. 1 is a fragmentary top perspective view of a novel tray of the present invention, and illustrates the tray affixed to a desk and a conventional keyboard and a mouse supported upon a slidable member slid to its right-hand position of use relative to an associated base.
Figure 2:
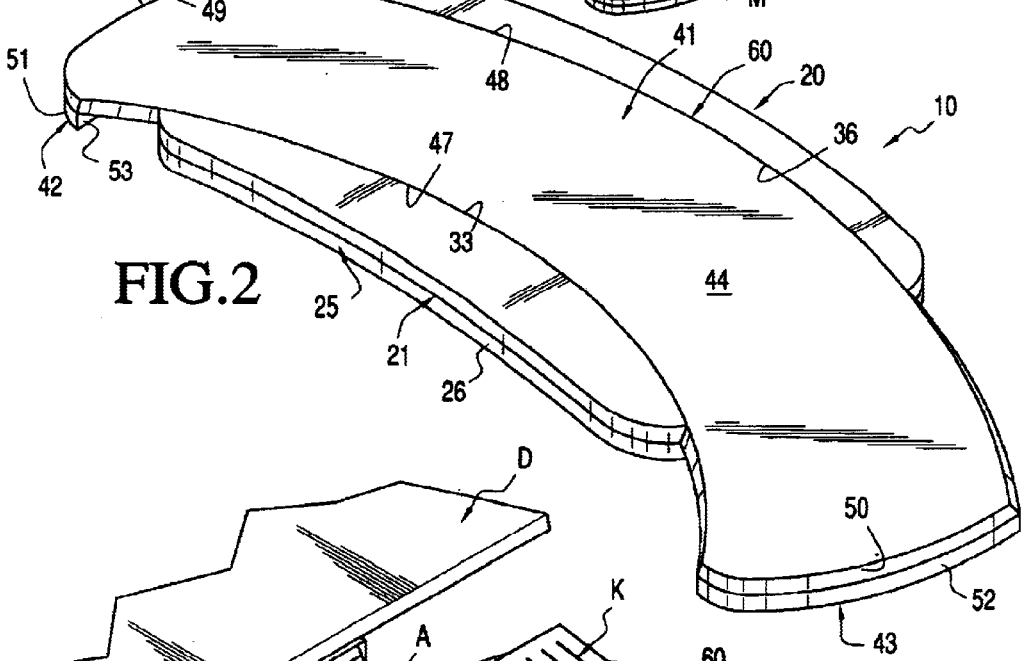
FIG. 2 is a top perspective view of the tray of the invention, and illustrates an arcuate upwardly opening and open-ended groove of the base within which the slidable member can be slid to accommodate left-hand and right-hand usage.
Figure 3:
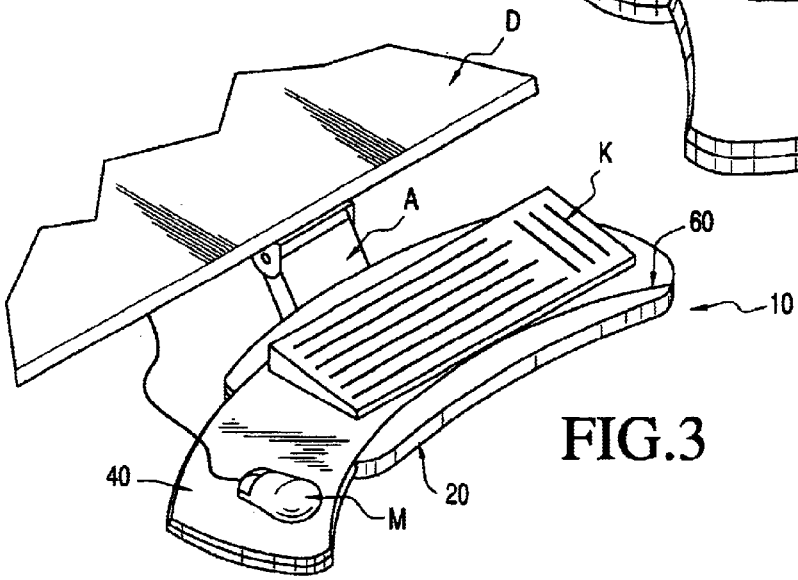
FIG. 3 is a fragmentary top perspective view of the tray, and illustrates the tray with its slidable member slid to its left-hand position of use.

A novel keyboard/mouse tray constructed in accordance with this invention is fully illustrated in the drawings, and is generally designated by the reference numeral 10. The tray 10 is illustrated in FIGS. 1 and 3 being attached to the underside of a desk D, table or the like by means of a conventional articulated or pivoted tray-supporting arm A. A conventional computer C having a screen S (FIG. 1) rests atop the desk D and conventionally associated therewith is one or more input devices, such as a keyboard K and a mouse M supported by and upon the tray 10.

The tray 10 includes a base 20 and a slidable member 30. The base 20 and the slidable member 40 can each be made of a single piece of material formed by compression molding, injection molding, milling or the like or from a plurality of separate pieces of such polymeric/copolymeric material, wood or metal. In the embodiment of the tray 10, the base 20 is constructed essentially from three pieces, as is the slidable member 30.

The base 20 includes a relatively flat base member 21 (FIG. 7) having a lower surface 22 from which projects a generally polygonal mounting portion 23; a top surface 24 and a peripheral surface 25. The peripheral surface 25 of the base member 21 includes a slightly concave front surface 26, a slightly convex rear surface 27 in parallel relationship to the front surface 26 and opposite generally parallel end surfaces 28, 29 (FIGS. 2 and 4 through 7).

Figure 5:
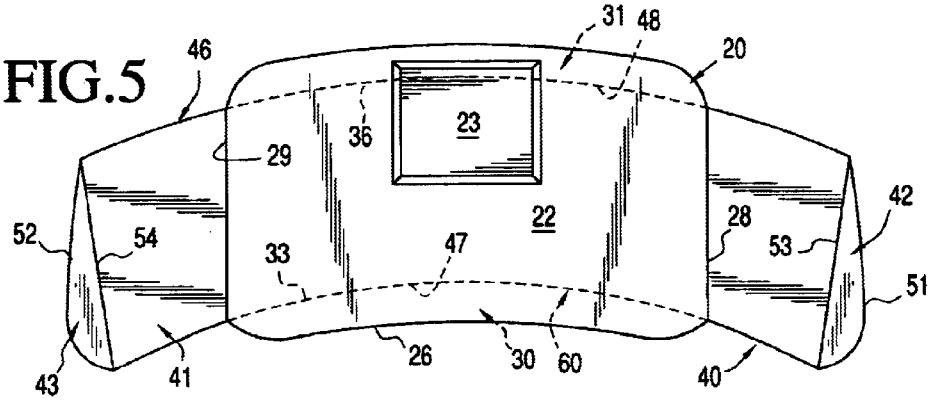
FIG. 5 is a bottom plan view of the tray, and illustrates a beveled edge of the mounting plate of the base and the stops at opposite ends of the slidable member.
Figure 6:
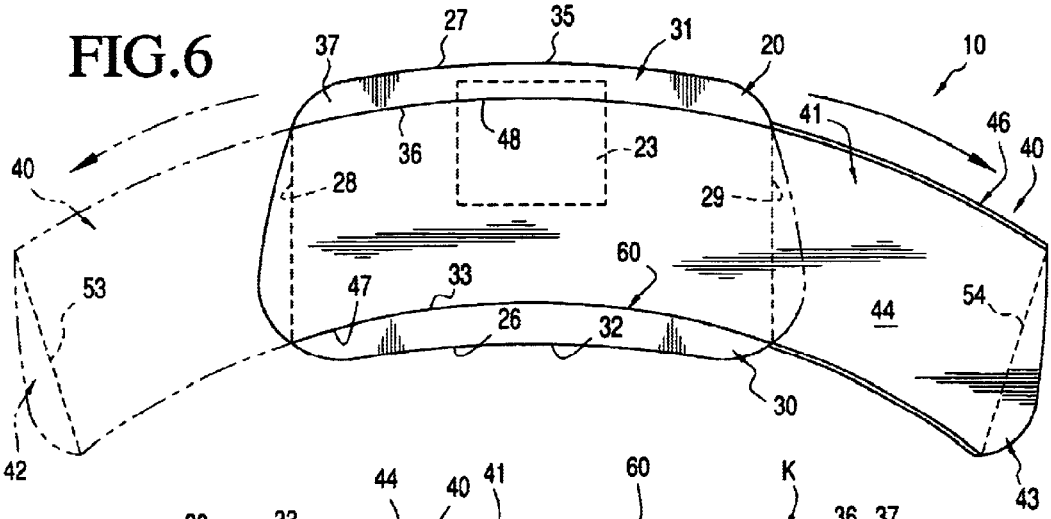
FIG. 6 is a top plan view of the tray, and illustrates in phantom and solid lines the slidable member extended to its left-most and right-most positions, respectively.
Figure 7:
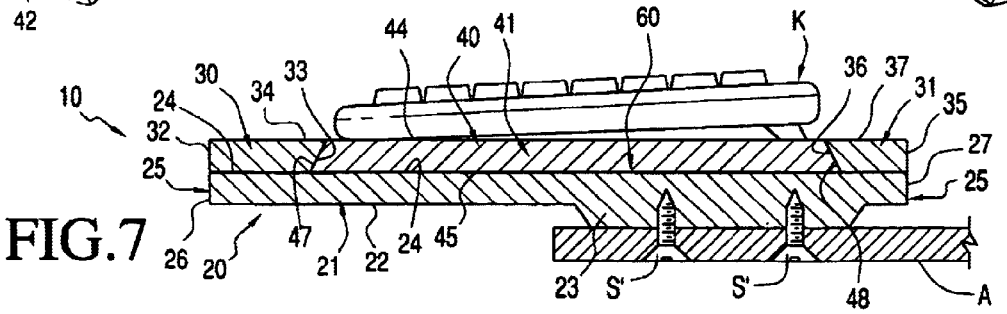
FIG. 7 is an enlarged cross-sectional view taken generally along line 7—7 of FIG. 1, and illustrates details of the tray including a three-piece base defining the groove of an upwardly converging dove-tail configuration and a like complementary mating dove-tail configuration of the slidable member seated in the groove, and screws attaching the base mounting portion to a tray supporting arm.

A separate base front member 30 and a separate base rear member 31 are conventionally bonded or otherwise secured to the upper surface 24 of the base member 21 or are constructed as integral portions thereof, as by the injection molding, compression molding or the like heretofore described. The base front member 30 includes a front surface 32 aligned with the front surface 26 of the base member 21 and an inclined surface 33 which sets off an acute angle (unnumbered) with a top surface 34 of the base front member 30 (FIG. 7). The base rear member 31 includes a convex surface 35 aligned with the rear surface 27 of the base member 21 and an inclined surface 36 defining an acute angle (unnumbered) with a top surface 37 of the base rear member 31. The inclined surfaces 33, 36 (FIG. 7) and the portion (unnumbered) of the top surface 24 of the base member 21 therebetween define a generally dove-tail groove 50 which converges upwardly away from the top surface 24, as viewed in FIG. 7, and opens end-wise through the end surfaces 28, 29. As viewed from above or below, the generally dove-shaped groove 60 is of a arcuate configuration as viewed from above (FIGS. 1 and 6) and below (FIG. 5).

The slidable member 40 is of a three-piece construction defined by a top member 41 and opposite end members, stop means or stops 42, 43. The top member 41 includes a top surface 44, a bottom surface 45 and a peripheral surface or edge 46 defined by a convexly curved and inclined front surface 47, a convexly curved and inclined rear surface 48, and opposite end surfaces 49, 50 which are contoured to the curved configuration of respective surfaces 51, 52 of the respective stops 42, 43 which also include linear abutment surfaces or edges 53, 54, respectively (FIG. 5). The edges 47, 48 define with the bottom surface 45 of the top member 41 a generally dove-tail cross-sectional configuration (FIG. 7) corresponding to that of the dove-tail cross-sectional configuration of the groove 60. The latter configurations of the groove 60 and the top member 41 effect accurate sliding movement of the slidable member 40 between the left-hand and right-hand limits illustrated in phantom outline and solid lines in FIG. 6 at which the abutment surface 54 of the stop 43 contacts the end surface 29 of the base member 21 and the abutment surface 53 of the stop 42 contacts the end surface 28 of the base member 21. Furthermore, in all relative positions of sliding motion of the slidable member 40 relative to the base 20, the respective surfaces 44 and 34, 37 lie in a substantially common horizontal plane, as is most readily apparent in FIG. 7 of the drawings, such that both the keyboard K and the mouse M are supported primarily upon the surface 44 but can be readily moved upon and across the surfaces 34, 44 and 37, 44.

Figure 4:
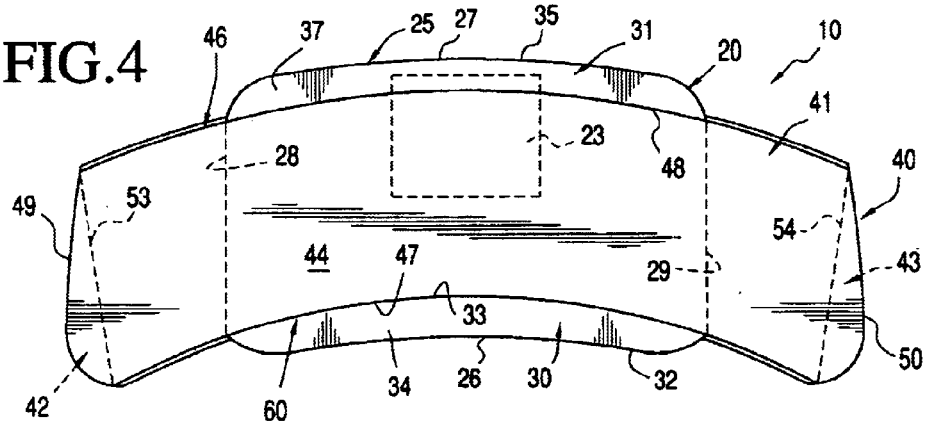
FIG. 4 is a top plan view of the tray, and illustrates in phantom outline a mounting portion of the base of the tray and a stop at each end of the slidable member which is shown in its centered position relative to the base to facilitate storage of the tray in an opening under a desk to which the tray is attached.

As is best illustrated in FIGS. 1 and 3 of the drawings, the mouse M is illustrated at the respective right-side and left-side of the slidable member 40 to accommodate respective right-hand and left-hand use/manipulation thereof. When the slidable member 40 is centrally located relative to the base 20, as is illustrated in FIGS. 4 and 5, the entire tray 10 can be readily stored or housed beneath the desk D by appropriate manipulation of the adjustable tray arm A in a conventional manner. The connection of the tray 10 to the tray arm A can be effected by any conventional means, such as screws S' (FIG. 7) threaded into the enlarged portion 23 of the base member 21.

Although a preferred embodiment of the invention has been specifically illustrated and described herein, it is to be understood that minor variations may be made in the apparatus without departing from the spirit and scope of the invention, as defined the appended claims.

What is claimed is:

1. A tray for supporting a plurality of input devices on a substantially common plane comprising a base including a top surface, a bottom surface and a peripheral surface therebetween, said peripheral surface being defined by a front surface, a rear surface and opposite side surfaces, a groove opening upwardly through said top surface and through said opposite side surfaces, said groove being defined by a bottom surface and two opposite inwardly opposing front and rear surfaces, a slidable member including a top surface, a bottom surface and a peripheral surface, said slidable member peripheral surface including a front surface, a rear surface and opposite side surfaces, said slidable member being in slidable engagement with said groove for right-to-left and left-to-right movement in a substantially horizontal plane, said slidable member top surface and said base top surface lying substantially in said substantially common plane, said slidable member top surface and said base top surface define uppermost supporting surfaces of said tray upon which input devices are adapted to be supported, means beneath said substantially common plane for maintaining said base and slidable member assembled in relative sliding relationship to each other, and stop means for limiting the sliding movement of said slidable member in each of the right-to-left and left-to-right movements thereof.

2. The tray as defined in claim 1 wherein at least one of said base and said slidable members are substantially arc-shaped in profile.

3. The tray as defined in claim 1 wherein said base and said slidable member are each substantially arc-shaped in profile.

4. The tray as defined in claim 1 wherein said slidable member is slidable between a left-most extended position and a right-most extended position.

5. The tray as defined in claim 1 wherein said slidable member is slidable between a left-most extended position and a right-most extended position, and adjacent ones of said base and slidable member opposite side surfaces are in contiguous transitional relationship to each other alternatively in each of maximum left-hand and right-hand positions of said slidable member relative to said base.

6. The tray as defined in claim 1 including in combination therewith a plurality of input devices, and one of said plurality of input devices is a computer keyboard and another of said plurality of input devices is one of a mouse, track ball, a joy stick, and an electronic writing pad.

7. The tray as defined in claim 1 wherein said slidable member opposite side surfaces are curved to smoothly align with said base opposite side surfaces when the slidable member is moved completely to either the right or the left.

8. The tray as defined in claim 1 wherein the base is of a one-piece, integral substantially homogenous construction.

9. The tray as defined in claim 1 wherein the base includes a first base member defining said groove bottom surface and two spaced top members defining said groove front and rear surfaces.

10. The tray as defined in claim 1 wherein the base includes a first base member defining said groove bottom surface and two spaced top members defining said groove front and rear surfaces, and a separate mounting plate carried by said base bottom surface.

11. The tray as defined in claim 9 wherein said two spaced top members are attached one proximate said base front surface and one proximate said base rear surface.

12. The tray as defined in claim 10 wherein said separate mounting plate is attached to said base bottom surface substantially centered relative to said base opposite side surfaces.

13. The tray as defined in claim 7 wherein said stop means is a stop proximate each of said slidable member side surfaces, and said stops each include a curved surface substantially corresponding in shape to the associated side member side surface.

14. The tray as defined in claim 13 wherein an inside surface of each stop contacts an associated one of said base opposite side surfaces to limit maximum right or left sliding movement of said slidable member.

15. The tray as defined in claim 13 wherein each of said stops is substantially aligned with an associated one of said slidable member opposite end surfaces.

16. The tray as defined in claim 1 wherein said base bottom surface is pre-drilled for attachment to a support.

17. The tray as defined in claim 16 including in combination therewith a support, and said support is an articulating mechanism adapted to be attached to one of a desk and a table.

18. The tray as defined in claim 1 including in combination therewith first and second input devices supported upon said slidable member top surface.

19. The tray as defined in claim 1 including in combination therewith first and second input devices supported upon said slidable member top surface, and said first input device is a keyboard.

20. The tray as defined in claim 1 including in combination therewith first and second input devices supported upon said slidable member top surface, and said second input device is a mouse.

21. The tray as defined in claim 1 including in combination therewith first and second input devices supported upon said slidable member top surface, and said first and second input devices are a respective keyboard and mouse.

22. A combination comprising a tray, a keyboard and a mouse; said tray including a base defined at least in part by a top surface, a bottom surface and a peripheral surface therebetween, said peripheral surface being defined by a front surface, a rear surface and opposite side surfaces, a groove opening upwardly through said top surface and through said opposite side surfaces, said groove being defined by a bottom surface and two opposite front and rear surfaces, said tray further including a slidable member having a top surface, a bottom surface and a peripheral surface, said slidable member peripheral surface including a front surface, a rear surface and opposite side surfaces, said slidable member being in slidable engagement with said groove for right-to-left and left-to-right movement, said slidable member top surface and said base top surface lying substantially in a common plane, said slidable member top surface and said base top surface define uppermost supporting surfaces of said tray upon which input devices are adapted to be supported, means beneath said substantially common plane for maintaining said base and slidable member assembled in relative sliding relationship to each other, and said keyboard and said mouse being supported upon said slidable member top surface.

23. The combination as defined in claim 22 wherein at least one of said base and said slidable portion are substantially arc-shaped in profile.

24. The combination as defined in claim 22 wherein said base and said slidable member are each substantially arc-shaped in profile.

25. The combination as defined in claim 22 wherein said slidable member is slidable between a left-most extended position and a right-most extended position.

26. The combination as defined in claim 22 wherein said slidable member is slidable between a left-most extended position and a right-most extended position, and adjacent ones of said base and slidable member opposite side surfaces are in contiguous transitional relationship to each other alternatively in each of maximum left-hand and right-hand positions of said slidable member relative to said base.

27. The combination as defined in claim 22 including stop means for limiting the sliding movement of said slidable member in each of the right-to-left and left-to-right movements thereof.

28. The combination as defined in claim 22 wherein said slidable member opposite side surfaces are curved to smoothly align with said base opposite side surfaces when the slidable member is moved completely to either the right or the left.

29. The combination as defined in claim 22 wherein the base is of a one-piece, integral substantially homogenous construction.

30. The combination as defined in claim 22 wherein the base includes a first base member defining said groove bottom surface and two spaced top members defining said groove front and rear surfaces.

31. The combination as defined in claim 22 wherein the base includes a first base member defining said groove bottom surface and two spaced top members defining said groove front and rear surfaces, and a separate mounting plate carried by said base bottom surface.

32. The combination as defined in claim 30 wherein said two spaced top members are attached one proximate said base front surface and one proximate said base rear surface.

33. The combination as defined in claim 31 wherein said separate mounting plate is attached to said base bottom surface substantially centered relative to said base opposite side surfaces.

34. The combination as defined in claim 28 including stop means for limiting the sliding movement of said slidable member in each of the right-to-left and left-to-right movements thereof.

* * * * *